United States Patent [19]

Lieberman

[11] 4,019,220

[45] Apr. 26, 1977

[54] PISTON ASSEMBLY FOR DOOR CLOSER

[75] Inventor: Sidney Lieberman, Lancaster, Pa.

[73] Assignee: Reading Door Closer Corporation, Reamstown, Pa.

[22] Filed: Jan. 13, 1976

[21] Appl. No.: 648,627

[52] U.S. Cl. ..... 16/59; 16/62; 74/422; 92/136; 403/356; 403/404

[51] Int. Cl.[2] ..... E05F 3/04; F16H 1/04

[58] Field of Search ..... 16/56, 59, 62, 64, 69, 16/79; 74/439, 422, 457; 403/11, 356, 358, 404; 92/128, 136

[56] References Cited

UNITED STATES PATENTS

| | | | |
|---|---|---|---|
| 1,002,236 | 9/1911 | Dumont | 74/439 |
| 1,115,557 | 11/1914 | Livermore | 74/439 |
| 2,024,472 | 12/1935 | Norton | 16/62 |
| 2,192,745 | 3/1940 | Hurd | 16/56 |
| 3,399,494 | 9/1968 | Hendrickson | 92/136 |
| 3,777,589 | 12/1973 | Adams | 74/422 |
| 3,834,247 | 9/1974 | Belsdorf et al. | 74/422 |

*Primary Examiner*—Werner H. Schroeder
*Assistant Examiner*—Conrad L. Berman
*Attorney, Agent, or Firm*—Robert C. Podwil

[57] ABSTRACT

Hydraulic door closer apparatus comprises a cylinder and an elongated piston disposed in the cylinder, the piston being made of relatively easily machined material, but having associated with it a rack of harder, wear and impact-resistant material for transmitting forces and motion to and from the piston.

6 Claims, 3 Drawing Figures

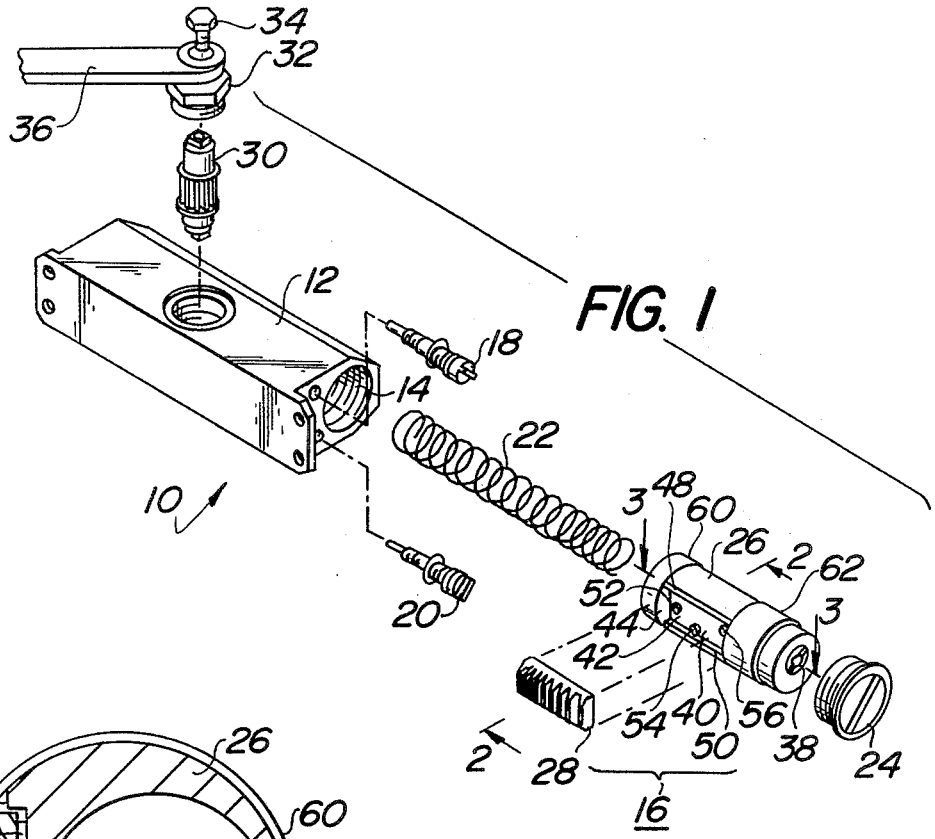
FIG. 1
FIG. 2
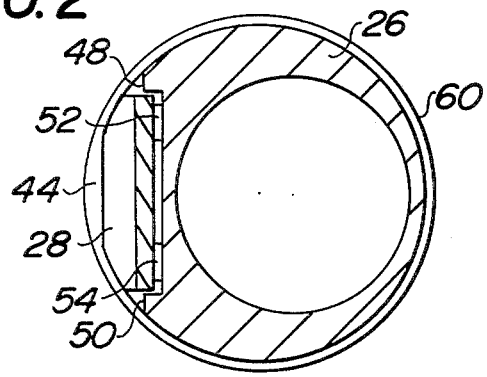
FIG. 3
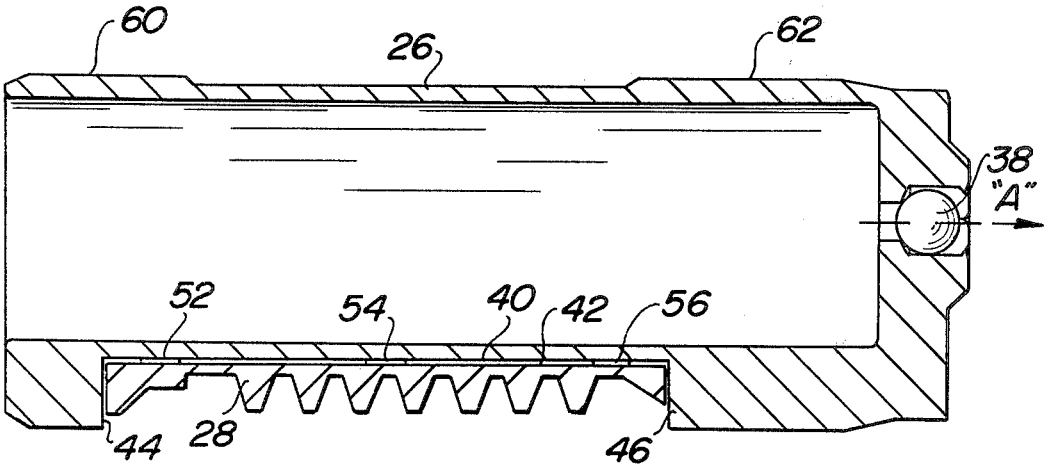

PISTON ASSEMBLY FOR DOOR CLOSER

This invention relates to hydraulic door closer apparatus, and more particularly, to a piston assembly for a hydraulic door closer.

Hydraulic door closers such as those illustrated in U.S. Pat. No. 2,024,472 to Norton, issued Dec. 17, 1935, No. 2,192,745 to Hurd, issued March 5, 1940, and No. 3,114,541 to Coffey, issued Dec. 17, 1963, are of the general type to which this invention relates. Door closers such as those of the Norton and Hurd patents utilize a spring-urged hydraulic piston to bias a door to its closed position. Typically, the force generated by the spring is transmitted between the door closer and, depending upon where the closer is mounted, either the door or a door frame. For this purpose, it is usual to provide a linkage consisting of a pair of links, coupled to the unit and to the door or door frame, as the case may be. In the Norton and Hurd patents referred to above, a rack and pinion arrangement is used to convert the linear movement of the piston within the device to rotary motion characteristic of the link or control arm.

The rack and pinion are typically subjected to highly leveraged tooth forces, and may, because of their function, encounter considerable impact loads. In conventional door closers of this type, the piston is made in one piece and, therefore, the materials requirement for the entire piston is determined by the need for hardness, impact resistance and wear resistance in the teeth of the rack. The materials requirements for the other portions of the piston are different, and require wear resistance and abrasion resistance rather than impact resistance, but the difficulties in working hard or highly hardenable materials in one piece are usually accepted in order to obtain the desired properties in the rack.

It is, therefore, a principal object of this invention to provide, for use in a door closer, a piston assembly in which the main body of the piston consists of relatively easily formed material, but the rack is made of relatively hard, wear and impact-resistant material, and is coupled to the main part of the piston in a manner which obviates the need for careful positioning or the use of fasteners. It is another object of this invenion to provide such a piston assembly wherein the machining which must be done on the piston (a) so that the piston will fit within the door closer unit, and (b) to accommodate receipt of the rack is kept to a practical minimum. In one operative form of the invention, making of the main body of the piston involves only die casting, followed by relatively simple and inexpensive machining processes. Thus, it is a general object of this invention, and a particular advantage of it, that different materials and machining processes be selected for the main body and the rack so as to optimize the materials and materials working requirements for each part. For example, where the application permits it, casting of metal, powdered metal or plastic or other relatively inexpensive forming techniques can be used for the main body of the piston, with the least expensive appropriate material. More difficult forming or machining techniques may be used for only the harder to work material constituting the rack, and selection of the material for the rack not be influenced by material or material-working considerations which pertain to the main body of the piston but not the rack. Similarly, techniques such as casting, powder metallurgy, forging, stamping, hobbing or broaching which may be desirable in some instances for the rack but not suitable or efficient for the main body of the piston, may be used for the rack without affecting economical manufacture of the main body of the piston.

Other objects will appear hereinafter.

The foregoing and other objects are realized, in a presently preferred form of the invention, by means of a piston having an outwardly facing recess portion, the recess portion having a bottom wall and spaced end walls, and means projecting from the bottom wall to support a rack. Thus, fitting of the rack to the piston is simplified by the configuration for the seat which receives rack, and the need for machining either the rack or seat to close tolerances, which are difficult and expensive to attain, is obviated.

For the purpose of illustrating the invention, there is shown in the drawings a form of the invention, which is presently preferred, it being understood, however, that the invention is not limited to the precise arrangement and instrumentalities shown.

FIG. 1 is an exploded view, in perspective, showing the general arrangement of a door closer with which the present invention may be used.

FIG. 2 is a cross-sectional view of a piston for such a door closer, taken along the line 2—2 in FIG. 1.

FIG. 3 is a longitudinal cross-sectional view taken along the line 3—3 in FIG. 1.

Referring now to the drawings in detail, wherein like reference numerals indicate like elements, there is seen in FIG. 1, door closer apparatus designated generally by the reference numeral 10. The door closer apparatus 10 includes a case or housing 12, provided with a bore 14, into which is received a piston assembly designated generally by the reference numeral 16.

The housing 12 will be understood by those skilled in the art to have within it suitable fluid passages, not shown. Adjustable valves 18 and 20 are associated with the passages, and control fluid flow within them.

Received within the bore 14 is a return spring 22 for the previously mentioned piston assembly 16. An end cap 24 serves to retain fluid within the door closer apparatus 10.

The piston assembly 16, which will be described in greater detail below, comprises a main or body portion 26 and a rack 28 associated therewith. The main or body portion 26 of the piston assembly 16 may be made of easily machinable and die-castable material. For example, in one presently preferred form of the apparatus, the body portion 26 is made of aluminum A-380 hardened by conventional processes. The rack is made of relatively wear and impact-resistant material suitable for use in gearing. In one of its forms, the rack 28 is made of 4140 steel. Those skilled in the art will be able to select from among available materials of known properties those suitable for use in the body portion and rack in accordance with this invention. The terms "easily machinable", "hard" and "wear and impact-resistant", and other terms descriptive of the physical properties of the materials for these elements, are used herein as relative terms, with reference to the desired or required properties of the elements.

It will be understood that the piston assembly 16 is reciprocable within the bore 14, and that the bore 14 is ordinarily filled with fluid. The rack 28 engages a pinion 30 pivotably mounted by means of suitable bearings and bearing housings, such as the bearing housings 32, seen in FIG. 1, in the housing 12. A shaft screw 34 locks the control arm 36 to the pinion 30 to carry rotary motion of pinion 30 through the housing 12. A suitable linkage such as the control arm 36 illustrated in FIG. 1 cooperates with the shaft screw to transmit motion of the pinion 30.

Referring now to FIGS. 1 and 3, the body portion 26 of the piston assembly 16 is provided with a ball-valve 38 which permits selective fluid flow through the body portion 26. In operation, opening of the door, not shown, with which door closer apparatus is associated, causes movement of the control arm 36 and rotation of the pinion 30, which, in turn, causes the piston assembly 16 to traverse the bore 14 of the housing 12. Such movement of the piston assembly 16 causes opening of the ball-valve 38 to permit free flow of fluid in the direction depicted by the arrow "A" in FIG. 3, and results in compression of the return spring 22, one end of which is lodged within an internal bore of the body portion 26. Upon release of the door, the spring 22 biases the piston assembly 16 toward the right in FIGS. 1 and 3 and the linear movement of the piston assembly 16 causes in turn rotation of the pinion 30 and movement of control arm 36 to bias the door to a closed position.

The manner in which the body portion 26 and rack 28 of the piston assembly 16 are associated in accordance with the invention will be described in detail.

The body portion 26 includes a longitudinally extending recess portion 40, extending generally parallel to the longitudinal axis of the body portion 26. The recess portion 40 is defined by a bottom wall 42, a pair of end walls 44 and 46, and side walls 48 and 50. The peripheral dimensions of the rack are such that it can be received between the end walls 44, 46 and side wall 48, 50.

Projecting from the bottom wall are bosses 52, 54 and 56, the end faces of which define a tripodal support for the rack 28. It should now be apparent that the rear face of the rack 28, the bosses 52, 54 and 56 in conjunction with the above-mentioned end walls 44, 46, and side walls 48 and 50 serve to maintain the rack 28 in the proper operative disposition with respect to the body portion 26, and, therefore, also, the pinion 30. The bottom wall 42 of the body portion 26 need not be precision machined, since it is the bosses 52, 54 and 56, not the bottom wall 42, which determine the position of the rack 28. Use of three bosses, the preferred number, ensures against rocking of the rack because the three points of support determine a plane upon which the rear surface of the rack 28 can rest.

The present invention consists of the body portion 26 and rack 28, each of which can be made by different processes and each of which can be made from different materials, and requires relatively little machining. In regard to the body portion 26, the cylindrical surfaces 60 and 62, which ride in the bore 14, are machined, as are internal passageways of the bore 14. In regard to the rack, its side, end and rear faces need only be flat, but no intricate machining is called for.

The present invention may be embodied in other specific forms without departing from its spirit or essential attributes, and, accordingly, reference should be made to the appended claims rather than the foregoing specification, as indicating the scope of the invention.

I claim:

1. For use in hydraulic door closer apparauts, a piston comprising a body portion and a rack coupled to said body portion transmitting forces to and from said piston, said rack being made of relatively hard, wear and impact-resistant material, and said body portion being made of relatively easily machinable material, and means on said piston for removably supporting and positioning said rack in operative association with said piston, said last-mentioned means comprising a recess portion in said piston extending longitudinally with respect to said piston and having a bottom wall, side wall portions and spaced end walls, the length of said recess portion being slightly greater than the length of said rack so as to constrain said rack from longitudinal movement with respect to the piston, and said side wall portions being spaced apart by a distance slightly greater than the width of said rack so as to constrain said rack from lateral movement with respect to the longitudinal axis of said piston, and means associated with said bottom wall and adapted to engage a rear face of said rack to maintain said rack in spaced relation with respect to said bottom wall and in a desired position with respect to the periphery of said piston, said means associated with said bottom wall comprising a plurality of spaced bosses projecting from said bottom wall into engagement with said rear face of said rack.

2. Hydraulic door closer apparatus in accordance with claim 1, wherein there are three of said bosses, said bosses providing tripodal support for said rack.

3. Hydraulic door closer apparatus comprising a cylinder, an elongated piston disposed in said cylinder, linkage means operatively coupled to said piston for transmitting forces to and from said piston, and rack and pinion means coupled to said piston and said linkage means, respectively, said rack and pinion means comprising a rack of relatively hard, wear and impact-resistant material, a pinion coupled to said cylinder and extending into engagement with said rack, said piston being made of relatively easily machinable material, and means on said piston for removably supporting and positioning said rack in operative association with said piston, said last-mentioned means comprising a recess portion in said piston extending longitudinally with respect to said piston and having a bottom wall, side wall portions, and spaced end walls, the length of said recess portion being slightly greater than the length of said rack so as to constrain said rack from longitudinal movement with respect to the piston, and said side wall portions being spaced apart by a distance slightly greater then the width of said rack so as to constrain said rack from lateral movement with respect to the longitudinal axis of said piston, and means projecting from said bottom wall and adapted to engage a rear face of said rack to maintain said rack in spaced relation to said bottom wall and a desired position with respect to the periphery of said piston and the bore of said cylinder, said means projecting from said bottom wall comprising a plurality of spaced bosses projecting from said bottom wall into engagement with said rear face of said rack.

4. Hydraulic door closer apparatus in accordance with claim 3, comprising three of said bosses, said bosses provided a tripodal support for said rack.

5. For use in hydraulic door closer apparatus of the type comprising a hydraulic piston and linkage means coupled to the piston for transmitting forces to and from said piston, an elongated piston having means thereon for removably supporting and positioning a rack in operative association with said piston, said means comprising an outwardly facing recess portion in said piston extending longitudinally with respect to said piston, said recess portion having a bottom wall, side wall portions extending longitudinally with respect to said piston, and spaced end walls, and a plurality of spaced bosses projecting from said bottom wall to support a rack in spaced relation to said bottom wall.

6. Apparatus in accordance with claim 5, comprising three of said bosses, said bosses providing a tripodal support for a rack.

* * * * *